United States Patent [19]

Lloyd

[11] Patent Number: 4,486,252

[45] Date of Patent: Dec. 4, 1984

[54] METHOD FOR MAKING A LOW NOISE CABLE

[75] Inventor: Richard B. Lloyd, Sunnyvale, Calif.

[73] Assignee: Raychem Corporation, Menlo Park, Calif.

[21] Appl. No.: 299,428

[22] Filed: Sep. 4, 1981

Related U.S. Application Data

[63] Continuation-in-part of Ser. No. 195,268, Oct. 8, 1980, abandoned.

[51] Int. Cl.[3] ..... H01B 13/22

[52] U.S. Cl. ..... 156/51; 156/54; 156/55; 156/56; 156/298; 174/36; 174/102 SC; 174/105 SC; 427/118; 427/120

[58] Field of Search ..... 156/51, 52, 53, 54, 156/55, 56, 298; 174/36, 102 R, 102 SC, 105 R, 105 SC; 427/118, 120

[56] References Cited

U.S. PATENT DOCUMENTS 3,351,706 11/1967 Gnerre et al. ..... 156/55 X

*Primary Examiner*—Robert A. Dawson

*Attorney, Agent, or Firm*—James W. Peterson

[57] ABSTRACT

A low mechanical noise coaxial cable for suppressing noise due to mechanical movement of the cable wherein the cable includes a central conductor, a dielectric surrounding the conductor, electrical shielding embedded in conductive material surrounding the dielectric and preferably, jacketing structure holding the above recited elements in place.

6 Claims, 5 Drawing Figures

METHOD FOR MAKING A LOW NOISE CABLE

CROSS REFERENCE TO RELATED APPLICATION

This application is a continuation-in-part of my copending application, Ser. No. 195,268, filed Oct. 8, 1980, now abandoned, the disclosure of which is incorporated herein by reference.

BACKGROUND OF THE INVENTION

At least as early as the 1950's, there has been an important need for cables having low noise qualities where the noise in the cable is induced by mechanical movement of the cable (as used herein noise refers to an extraneous electrical signal in a cable and mechanical noise refers to noise caused by mechanical movement of the cable, e.g. movement of the conductor and/or shield with respect to the dielectric). In the early 1950's shock and vibration measurements of missile firings were attempted. Cables were attached to the measuring equipment and a strategically placed accelerometer. The measurements were difficult to make because noise generated in the cable by vibration of the cable and the accelerometer often masked the signal to be measured.

More recently the medical industry has developed equipment requiring low mechanical noise cables. For instance, when a patient is hooked to an EEG machine the attaching cables vibrate as the patient runs on a threadmill. Other medical applications for low mechanical noise cables include EKG machines where cables are attached to the patient's head. In addition, high beam amplifies, oscilliscope probes and the like require low mechanical noise cables.

Representative of the attempt to provide the needed cables is U.S. Pat. No. 2,622,152 to S. G. Rosch which suggests a coaxial cable having a central metallic conductor surrounded by a dielectric material wrapped with dielectric tape formed of a conductive material and surrounded further by a shielding layer which is in turn surrounded by an insulating jacket. Similarly, U.S. Pat. No. 2,614,172 issued to Greenfield et al., suggests enclosing a thermo magnetic core within a layer of metal surrounded by a tube of dielectric material, the tube in turn surrounded by a metallic shielding material comprising a braid of fine wires of good electrical conductivity.

Further disclosures such as U.S. Pat. No. 3,209,064 issued to Cutler, suggests a plurality of pairs of conductors mutually insulated and surrounded by insulating members of polyethylene material in a separate layer of polyethylene-type insulating material. Surrounding the separate polyethylene material is a conductive shielding member and insulating jacket similar to those previously discussed.

The most recently discovered attempt to fulfill the need for low mechanical noise coaxial cable is Gulton Instrumentation Division's (of E. I. duPont de Nemours & Company) C-5 series cable which includes a Teflon* layer as the primary insulator over a copper-weld conductor and bonding the two together to prevent relative movement therebetween.

*Federally Registered Trademark of E. I. duPont de Nemours & Company

None of the devices discussed above suggests or in any way teaches applicant's invention of a low mechanical noise cable having a central conductor surrounded by a dielectric in turn surrounded by electrical shielding embedded in a conductive material and said elements preferably held in place by jacketing means.

SUMMARY OF THE INVENTION

A low noise cable for suppressing noise due to mechanical movement comprising a conductor, a dielectric surrounding the conductor, electrical shielding means embedded in conductive matter surrounding and in contact with the dielectric, and preferably, a jacketing means holding the above recited elements in place.

OBJECTS OF THE INVENTION

It is a primary object of this invention to provide a cable having low noise properties where the noise results from mechanical movement of the cable.

It is an object of this invention to provide a coaxial cable including a plurality of layers wherein one layer surrounding the conductor includes electrical shielding means embedded into conductive or semi-conductive matter.

It is a further object of this invention to provide a low noise coaxial cable having an inner conductor surrounded by a dielectric in turn surrounded by electrical shielding embedded into conductive matter, preferably held in place by a jacket means.

It is a general object of this invention to provide a low mechanical noise coaxial cable which resists noise due to mechanical movement of the coaxial cable in low current applications.

DETAILED DESCRIPTION OF THE INVENTION

Figure 1:
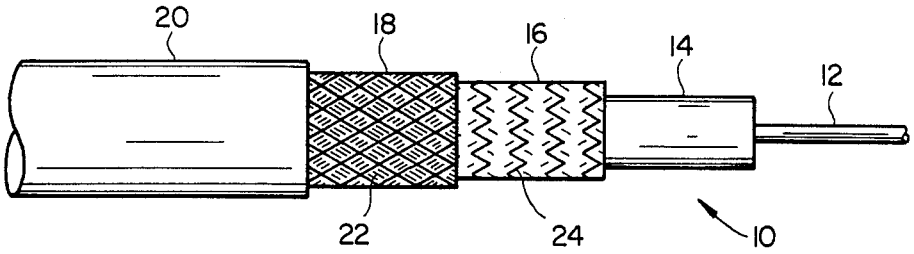
FIG. 1 is a partial cross-sectional view of a low noise coaxial cable in accordance with this invention.

With reference to the drawings wherein like reference characters designate like or corresponding parts throughout the several views and referring particularly to FIG. 1 there is seen a low noise coaxial cable in accordance with this invention generally designated by the numeral 10. The coaxial cable of the instant invention is especially suited for low noise due to mechanical movement of the cable such as vibration, shaking and deformation, where a low current is applied through the cable.

Particular applications of the cable in accordance with this invention may be found where the cable itself is subjected to mechanical movement during usage. In said applications the signal level is usually quite low and noise induced by mechanical movement, e.g. shock, vibration or the like, will ordinarily present a problem unless a low noise cable is used. The standard non-low noise coaxial cable includes a central conductor surrounded by an insulator (dielectric), which is in turn surrounded by braided electrical shielding and a surrounding outer jacket. As the cable is flexed, vibrated or the like, the dielectric moves against the electrical shielding building up an electrical charge in the cable which creates noise thereby interfering with the signal.

Typically, low mechanical noise cables have included a conductive or semi-conductive layer between the braiding and the dielectric to reduce the charge built up in the cable by providing a low impedance escape means during discharge. However, the problem of movement between the shielding and the conductive layer and the charge resulting therefrom remained for applicant herein to solve.

Figure 2:
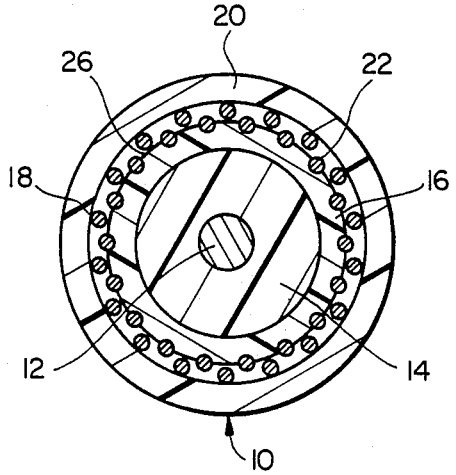
FIG. 2 is an enlarged full cross-sectional view of the low noise coaxial cable shown in FIG. 1.

The low noise coaxial cable in accordance with this invention includes a conductor 12 surrounded by a dielectric 14, which is in turn surrounded by conductive matter 16, which is surrounded by a shielding means 18 and a jacket 20 which preferably wraps the elements recited above, thereby holding them in place. Unlike conventional low noise coaxial cable, the shielding layer is embedded in the conductive matter 16 as shown in FIGS. 1 and 2.

Preferably, the conductive matter comprises conductive material having a resistivity of between $10^3$ to $10^{-6}$ ohm-centimeter. Applicant presently uses semi-conductive material having a resistivity of 5 ohm-centimeter. It is specifically understood that conductive matter includes both conductive and semi-conductive material. Additionally, it is understood that the material used in making the conductive matter is preferably soft when embedding the electrical shielding means therein. It will of course be appreciated that the conductive matter need not be soft before or after the electrical shielding means has been embedded therein.

For instance, applicant currently uses a thermoplastic of ethlylene vinyl acetate copolymer filled with carbon black. During embedding of the shielding into the conductive matter the above described copolymer is heated and becomes soft to facilitate said embedding. The thermoplastic softens only upon heating and the heating may be done at the time of embedding. In addition, other materials which are soft prior and after embedding of the shielding can of course be used, e.g. conductive elastomers. Further materials such as conductive thermosets which are soft before and during embedding and hard (by curing) after embedding can also be used.

The electrical shielding means 18 may be made of electrically conductive filaments 22 which are braided forming the shielding means as shown. The filaments 22 may then be embedded into the conductive layer 16 a predetermined distance by piercing the outer surface of the conductive matter the desired amount, e.g. 1 mil (0.001 inch) (as used herein embedding a depth of 1 mil means that the shielding penetrates the outer surface of the conductive layer a depth of one mil). The embedding of the filaments 22 of the shielding 18 causes impressions or imprints 24 to be created in the conductive matter 16.

FIG. 2 shows an enlarged cross-sectional view of the cable 10 wherein it may be seen that the filaments 22 of the shielding layer 16 causes the outer surface 26 of the conductive matter 16 to be deformed as shown and described above. Applicant has found that the greater the penetration of the shielding means into the conductive matter the greater the noise reduction as can be seen graphically in FIG. 4.

Applicant tested his cable using the standard Mil. C-17 test; a military test for mechanically induced noise taken from "Cables, Radio Frequency, Flexible and Semi-Rigid, General Specifications For" Paragraph 4.8.15. The test includes swinging a cable between two fixed points with a weight attached therebetween and measuring the resulting noise on an oscilliscope.

Figure 4:
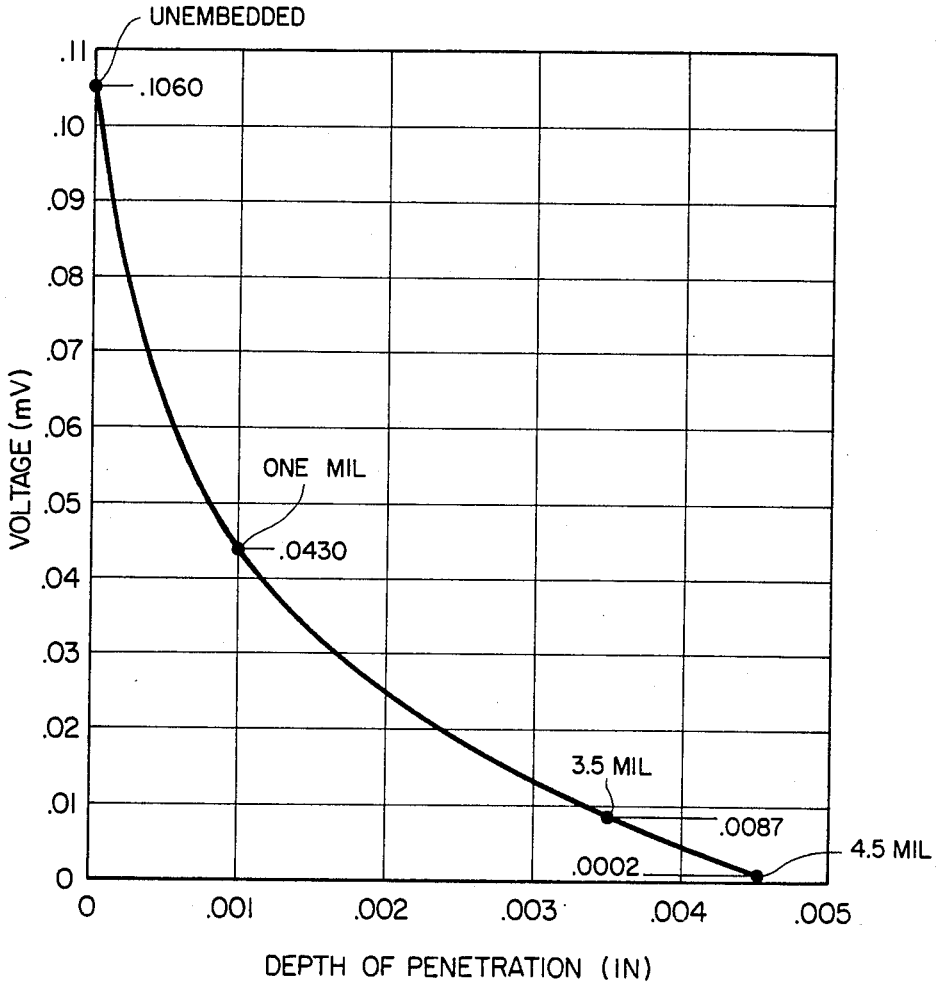
FIG. 4 is a graphic illustration of how mechanical noise varies with depth of penetration.

The results of the Mil. C-17 test are graphically shown in FIG. 4. As shown, applicant tested four (4) samples. The first sample is a present state of art low noise coaxial cable having the shielding means unembedded in the conductive layer. In each of the other samples, The shielding means penetrates the outer surface of the conductive layer a predetermined depth, i.e. 1 mil, 3.5 mils and 4.5 mils. As shown in the graph of FIG. 4 as the depth of penetration increases the amount of noise reduction also increases.

In the Mil. C-17, it was found that an unembedded conductive polymer low noise coaxial cable sample produced an average noise level of 0.106 milivolts. Embedding the shielding means filaments a depth of one mil (0.001 inch) produced an average noise level of 0.043 milivolts. At a depth of 3.5 mils, (0.0035 inch), the applicant's low noise cable in accordance with this invention produced an average noise level of 0.0087 and at a depth 4.5 mils (0.0045 inch), it was found that the average noise level produced from applicant's low noise cable was 0.0002, representing three orders of magnitude of noise level reduction over the presently known state of the art low mechanical noise coaxial cable.

Thus, significant noise reduction levels are achieved over the current state of the art low noise cable by having the shielding filaments embedded in the conductive polymer layer. Further, the greater the depth of penetration of the shielding into the conductive (including as used herein semi-conductive) polymeric matter the greater the noise reduction. FIG. 4 indicates that the depth of penetration/noise reduction relationship and curve is exponential in nature. It is apparent that embedding of approximately 4.5 mils or greater produces optimum noise reduction.

In forming the embodiment shown in FIGS. 1 and 2, the shielding 18 may be tightly woven so as to pierce the conductive matter 16 or alternatively the conductive layer 16 may be heated allowing the braid to be embedded into the conductive layer 16. Of course, a combination of either method may be used in order to embed the shielding in the conductive matter.

Figure 3:
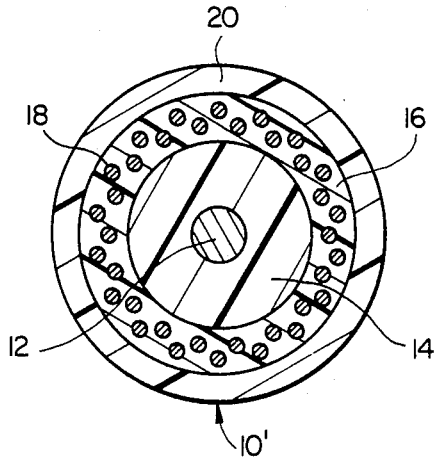
FIG. 3 is an alternative embodiment of a low noise coaxial cable in accordance with this invention having its electrical shielding encapsulated in the conductive matter.

With particular attention to FIG. 3 there is shown the fully embedded embodiment of applicant's low noise cable in accordance with this invention designated generally by the number 10' wherein the shielding is encapsulated within the conductive matter. There are at present two (2) preferred methods for encapsulating the shielding means in the conductive matter in accordance with the embodiment shown at 10'. The first method includes flowing conductive matter over, around and under the shielding means, thereby encapsulating the shielding in the conductive matter. The second method includes applying a first coating of conductive matter arround the dielectric, surrounding the first conductive matter coating with electrical shielding and applying a second coating of conductive matter around the shielding.

Figure 5:
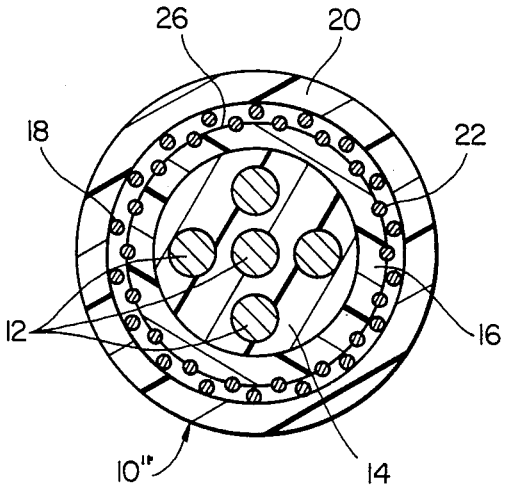
FIG. 5 is an enlarged cross-sectional view of another embodiment of the low noise coaxial cable in accordance with this invention.

With particular reference to FIG. 5, there is seen an alternative embodiment of the low noise cable in accordance with this invention, generally designated by the numeral 10'. As can be seen from the figure, the construction of the cable is the same as previously described embodiments, except that there is more than one (1) conductor 12 disposed in the dielectric material 14. In this way, the low noise cable in accordance with this invention may be used as a multiconductor cable as well as the single conductor cable previously described.

While the instant invention has been described by reference to what is believed to be the most practical embodiments, it is understood that the invention may embody other specific forms not departing from the spirit of the central characteristics of the invention. It should be understood that there are other embodiments which possess the qualities and characteristics which would generally function in the same manner and should be considered within the scope of this invention. The present embodiments therefore should be considered in all respects as illustrative and not restrictive, the scope of the invention being limited solely to the appended claims rather than the foregoing description and all equivalents thereto being intended to be embraced therein.

What is claimed:

1. A method for making a low noise cable comprising the steps of:

providing a conductor;

surrounding the conductor with a dielectric;

surrounding the dielectric with conductive matter; and encapsulating electrical shielding means within the conductive matter, said shielding means being spaced from the dielectric.

2. A method for making a low noise cable which comprises the steps of:

providing a plurality of conductors;

surrounding the conductors with dielectric;

surrounding the dielectric with conductive matter; and encapsulating electrical shielding means within the conductive matter, said shielding means being spaced from the dielectric.

3. The method as set forth in claim 1 wherein said shielding means are encapsulated within said conductive matter to a depth of at least 1 mil.

4. The method as set forth in claim 2 wherein said shielding means are encapsulated within said conductive matter to a depth of at least 1 mil.

5. The method as set forth in claim 3 wherein said shielding means are encapsulated within said conductive matter to a depth of at least 4.5 mils.

6. The method as set forth in claim 4 wherein said shielding means are encapsulated within said conductive matter to a depth of at least 4.5 mils.

* * * * *